US005625371A

United States Patent [19]

Miller et al.

[11] Patent Number: 5,625,371

[45] Date of Patent: Apr. 29, 1997

[54] FLAT PLATE TV ANTENNA

[75] Inventors: Paul E. Miller, Spring Lake, Mich.; Glen J. Seward, Cincinnati, Ohio; Robert M. Lynas, Spring Lake, Mich.

[73] Assignee: R.A. Miller Industries, Inc., Grand Haven, Mich.

[21] Appl. No.: 602,696

[22] Filed: Feb. 16, 1996

[51] Int. Cl.[6] ..... H01Q 21/00

[52] U.S. Cl. ..... 343/867; 343/870; 343/742

[58] Field of Search ..... 343/867, 870, 343/866, 742, 741, 743, 744, 749, 722; H01Q 21/00

[56] References Cited

U.S. PATENT DOCUMENTS

| | | | |
|---|---|---|---|
| 2,749,544 | 6/1956 | Pike | 343/742 |
| 2,787,788 | 4/1957 | Clough | 343/742 |
| 3,971,031 | 7/1976 | Burke | 343/744 |
| 4,012,742 | 3/1977 | Dempsey | 343/742 |
| 4,717,920 | 1/1988 | Ohe et al. | 343/712 |
| 4,721,963 | 1/1988 | Nagy et al. | 343/712 |
| 4,737,795 | 4/1988 | Nagy et al. | 343/712 |
| 4,758,166 | 7/1988 | Bonnett et al. | 343/712 |
| 4,769,655 | 9/1988 | Nagy et al. | 343/713 |
| 4,785,303 | 11/1988 | Clark et al. | 343/742 |
| 4,821,040 | 4/1989 | Johnson et al. | 343/700 MS |
| 4,866,453 | 9/1989 | Nagy et al. | 343/712 |
| 4,873,530 | 10/1989 | Takeuchi et al. | 343/713 |
| 5,049,892 | 9/1991 | Lindenmeier et al. | 343/713 |
| 5,079,560 | 1/1992 | Sakurai et al. | 343/713 |
| 5,124,714 | 6/1992 | Harada | 343/713 |
| 5,142,292 | 8/1992 | Chang | 343/742 |
| 5,198,826 | 3/1993 | Ito | 343/726 |

FOREIGN PATENT DOCUMENTS

| | | | |
|---|---|---|---|
| 2166000 | 4/1986 | United Kingdom | 343/742 |

OTHER PUBLICATIONS

H. Jasik, Antenna Engineering Handbook, McGraw-Hill, 1961, Chapter 22, pp. 22-1 through 22-20.

Hall et al., The ARRL Antenna Book, The American Radio Relay League, Inc., 1983, pp. 5-17 through 5-22.

*Primary Examiner*—Hoanganh T. Le

*Attorney, Agent, or Firm*—Varnum, Riddering, Schmidt & Howlett LLP

[57] ABSTRACT

A television antenna is constructed of a flat plate antenna comprising a plurality of concentric, rectangularly shaped loops formed of conductive material and disposed on a substrate. Each loop forms an antenna for signals in a predefined frequency band within the TV frequency spectrum. An additional loop is disposed within the plurality of concentric loops and is adapted for receiving signals in the FM frequency range. Each of the loops has four sides having an electrical length equivalent to one-quarter wavelength at a center frequency within a frequency band and each side of each antenna loop is connected to a side of another antenna loop and to one of a pair of antenna output terminals. The sides of each loop are formed by conductive strips deposited on a dielectric substrate which is particularly adapted for installation adjacent a dielectric roof panel or the like.

24 Claims, 4 Drawing Sheets

FLAT PLATE TV ANTENNA

BACKGROUND OF THE INVENTION

1. Field of the Invention

This invention relates to antennas and more particularly to a flat plate television antenna module.

2. Description of the Related Art

Television sets are often used in recreation vehicles, conversion vans, limousines and the like and such vehicles are typically equipped with an external television antenna. External antennas are of necessity kept small, and preferably encased in a streamlined housing, to reduce wind drag. This downsizing substantially lowers the efficiency of the antenna. The TV spectrum covers a large frequency span, down to 54 megahertz (MHz) at the low frequency end. A quarter-wavelength radiator and associated ground plane or a half-wave dipole is usually recommended for proper reception. However, at 54 MHz a quarter-wavelength is approximately 53 inches. An antenna of that size external to the vehicle is impractical due to the wind drag.

The reason for placing the antenna external to the vehicle, rather than internal is that the metallic vehicle structure prevents the proper reception of high frequency signals internal to the vehicle. In recent years, however, fiberglass has been used in the construction of the roof and other portions of many large trucks, recreational vehicles and other vehicles. Since fiberglass allows almost unaffected passage of high frequency signals, the television antenna can now be placed inside a vehicle.

Prior art TV antennas are typically of the dipole design with little or no radiation at the ends of the dipole. This creates an antenna which is highly directional. An annoying problem of such antennas in moving vehicles is that the level of the received signal changes as the direction of the vehicle changes, causing signal quality to fluctuate.

U.S. Pat. No. 5,402,134, issued Mar. 28, 1995 to Paul E. Miller et al., discloses a flat plat antenna module incorporating a mobile telephone antenna loop, an AM/FM antenna loop, and a CB antenna loop, which patent is incorporated by reference herein. A loop antenna of the type generally described in that patent does not require the metallic ground plane, is essentially an omnidirectional antenna and functions well in a fiberglass enclosure. However, such an antenna is not suitable for TV reception because of the bandwidth requirements of a TV antenna.

SUMMARY OF THE INVENTION

These and other problems of the prior art are solved in accordance with the present invention by means of a planar, omni-directional television antenna designed to be used within or adjacent a non-conductive structure, such as a fiberglass cab or roof. In accordance with this invention, the antenna comprises a plurality of conductors arranged to form a plurality of concentric antenna loops. Each loop is adapted to receive signals within a selected frequency range and the dimensions of each loop are selected for proper reception in the selected frequency range. The antenna is particularly useful as a vehicle TV antenna. Advantageously, the planar antenna may be readily inserted between the headliner, of a truck cab or the like, and a non-conductive roof panel and, since it is omni-directional, the signal fade out that occurs prior art antennas with changes in direction is eliminated.

In an embodiment of the invention, a TV antenna comprises a plurality of concentric loops with each of the loops having a perimeter length equivalent to a wavelength of signals at a center frequency of a frequency band in a multi-band TV frequency spectrum. In one particular embodiment of the invention, the television antenna comprises five substantially square loops with the dimensions of the sides of each loop being based on the center frequencies of a group of adjacent channels.

In one embodiment of the invention, the concentric loops are rectangularly shaped, preferably square, and formed of a conductive material deposited on the substrate. Each of the rectangularly shaped loops comprises first and second opposing loop sections, with each loop section formed of two adjacent, electrically interconnected sides of a rectangularly shaped loop. Each of the two adjacent sections has one end electrically connected to an antenna lead wire. Advantageously, each of the concentric loops forms two separate loop sections with each loop section connected to the two lead wires which connect the antenna to a television receiver through a balun. Each side of each of the loops has an electrical length equivalent to one-quarter wavelength of the signals at a selected frequency and each concentric loop forms two half-wavelength antennas at the selected frequency. The two half-wavelength antenna loop sections may be capacitively coupled by capacitors disposed between adjacent ends of two quarter wavelength sections of each half loop section. Capacitors are advantageously formed from conductive strips and may be adjusted as desired. The length requirement of each loop or half loop section has been found to be influenced by the characteristics of a dielectric roof or the like adjacent which the antenna may be installed. Advantageously, the electric length of each antenna loop may be readily adjusted by adjustment of the capacitors.

In one embodiment of the invention a single internal loop is used for the VHF range of 54 to 88 MHz covering with channels 2 through 6, a single loop is used for the 174 to 116 MHz frequency range of channels 7 through 13 and the three loops are used in the 470 to 884 MHz range covering channels 14 through 82. In another embodiment, four adjacently disposed loops are used to cover the 54 to 88 MHz range of channels 2 through 6, and three adjacently disposed loops are used to cover the 174 to 216 MHz range of channel 7 through 13 and two loops are used to cover the 470 to 890 MHz range of TV channels 14 through 82. The latter arrangement has been found to provide better reception in the frequency ranges of channels 2 through 6 and 7 through 13. The reduced number of loops in the high frequency range of 470 to 890 MHz has been found not to significantly affect reception in that frequency range.

In accordance with one aspect of the invention, quarter-wavelength sections of one loop extend parallel to quarter-wavelength sections of adjacent loops and adjacent parallel quarter-wavelength sections are electrically connected to opposite antenna lead wires.

BRIEF DESCRIPTION OF THE DRAWING

An embodiment of the invention as described hereafter in detail with reference to the drawing wherein.

DETAILED DESCRIPTION

Figure 1:
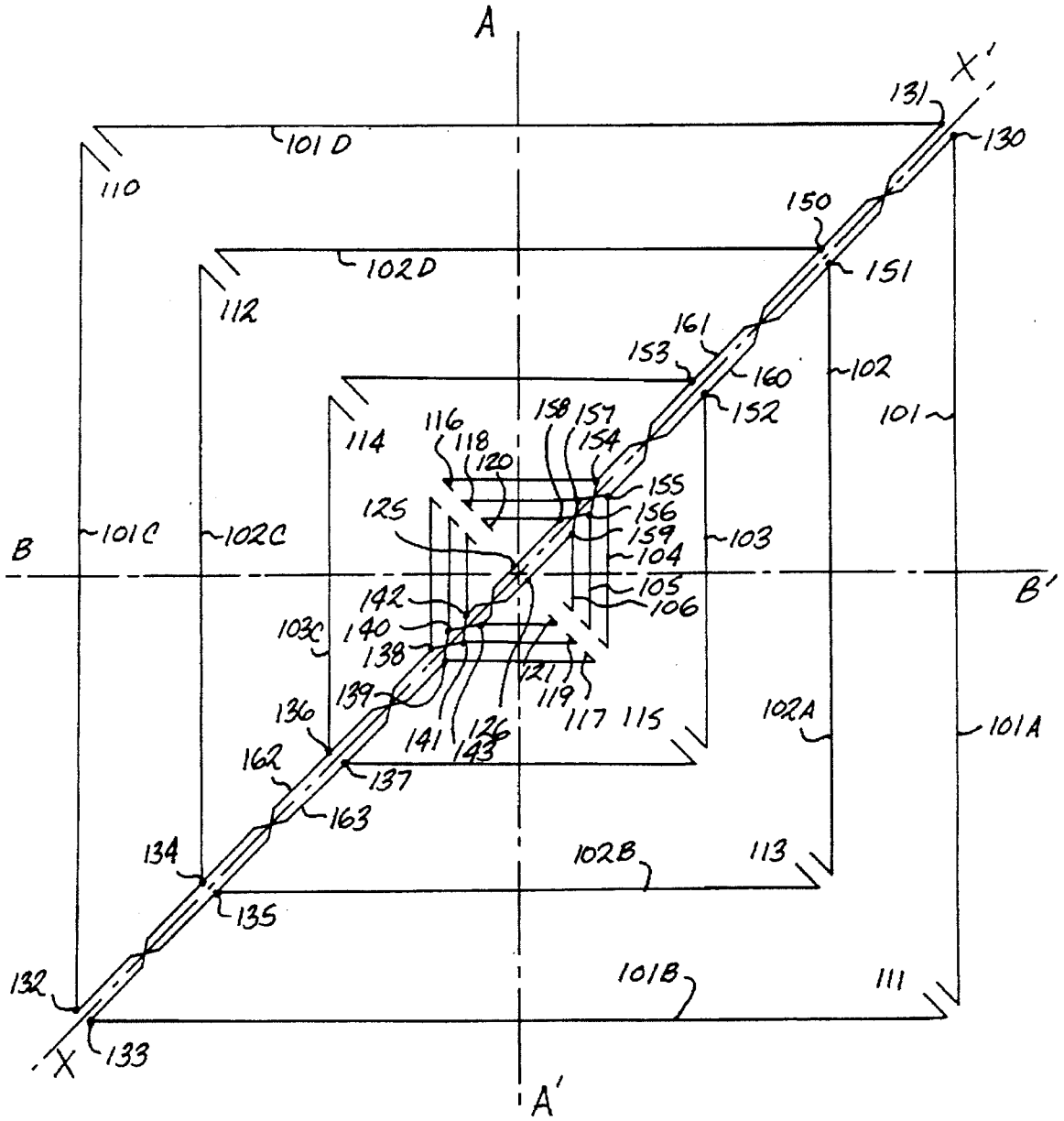
FIG. 1 is a schematic representation of a flat plate antenna incorporating the principles of the invention.

FIG. 1 shows a plurality of concentric, rectangularly shaped antenna loops 101 through 106. Each of the four sides of the loops 101 through 106 is formed of a conductor having an electrical length equal to one-quarter wavelength at a selected frequency. Each rectangular loop forms two opposing half loops, each comprising two conductor sections of a length equal to one-quarter wavelength at the respective selected frequency for each loop. The two sides of each half loop are capacitively coupled to each other by the capacitors 110 through 121. Each quarter wavelength conductor section of each of the loops is connected to one of a pair of antenna terminals 125, 126 by way of example, end point 130 of side 101*a* of loop 101 is connected via conductor 160 to the terminal 126 and end point 133 of side 101*b* of loop 101 is connected via conductor 163 to antenna terminal 125. In a similar fashion, end point 132 of side 101*c* of loop 101 is connected to antenna terminal 126 via conductor 162 and end point 131 of side 101*d* of loop 101 is connected via conductor 161 to antenna terminal 125.

As depicted in FIG. 1, each of the loops 101 through 106 comprises two substantially identical half loops on opposite sides of center line X–X' and opposite sides of the two half loops e.g. 101*a* and 101*c* are connected to the same antenna terminal i.e. terminal 126 via conductors 160 and 162, respectively. In the same manner, opposing sides 101*b* and 101*d* are connected to the same antenna terminal via conductors 163 and 161, respectively. In a similar fashion, opposing sides of each of the other loops 102 through 106 are connected to the same antenna terminal. Specifically, opposing end points 151, 134 are connected to terminal 125 and opposing end points 135, 150 of loop 102 are connected to antenna terminal 126; opposing end points 152, 136 of loop 103 are connected to terminal 126 and opposing end points 137, 153 of loop 103 are connected to antenna terminal 125; opposing end points 155, 138 and 139, 154 of loop 104 are connected to terminals 125 and 126, respectively; opposing end points 156, 140 and 141. 157 of loop 105 are connected to antenna terminals 126, 125, respectively; opposing end points 159, 142 and 143, 158 of loop 106 are connected to antenna terminals 125 and 126, respectively. In this manner, currents from opposite sides of each of the square antenna loops 101, 106 are conducted to the same antenna terminal. Furthermore, the end points of adjacent square loops are interconnected in such a manner that currents from corresponding sides of adjacent loops are fed to different ones of the two antenna terminals 125, 126. By way of example, sides 101*a* of loop 101, sides 102*c* of loop 102 and side 103*a* of loop 103 are connected to terminal 126 and side 101*c* of loop 101, side 102*a* of loop 102 and 103*c* of loop 103 are connected to terminal 125, to provide a balanced antenna structure. The terminals 125, 126 may be connected to a TV receiver via a well-known balun. In the embodiment shown in FIG. 1, loop 102 is provided to receive signals in the FM frequency band. An FM splitter may be added to the balun for connection to an FM receiver.

An antenna in accordance with this invention is preferably constructed of conductive strips deposited on a low loss dielectric substrate. The substrate is preferably square and somewhat larger than the dimensions of the largest antenna loop. Each loop is dimensioned such that each side of the loop has an electrical length equal to one-quarter wavelength at a center frequency of a selected band of frequencies in the TV spectrum. The largest antenna loop, loop 101, in one embodiment has a length of 42.2 inches. This corresponds to one-quarter wavelength of a signal at 68.9 MHz. This frequency is at the geometric center of a band of frequencies spanning channels 2 through 6 of the TV spectrum extending 54 MHz to 88 MHz.

Loops 103 through 106 are dimensioned to provide an antenna in which the length of one of the sides corresponds to one-quarter wavelength of a frequency spanning a selected group of television channels. Table A below lists the physical dimensions and the corresponding frequency characteristics of the loop as well as the frequency band and corresponding channels for which each loop is designed. Included in FIG. 1 and in Table A is the antenna loop 102 which has sides which are each 30.3 inches in length or one-quarter wavelength of a signal at 97.5 MHz. This antenna covers the standard FM frequency band ranging from 88 to 108 MHz. While this antenna is not part of the TV antenna, it is conveniently incorporated in the TV antenna structure of this invention and may be readily included. The FM antenna characteristics are included in Table A.

TABLE A

| LOOP # | LENGTH OF ONE SIDE | CENTER FREQ (MHz) | CHANNEL COVERAGE CHANNEL NO. | CHANNEL COVERAGE FREQ. (MHz) |
|---|---|---|---|---|
| 101 | 42.2" | 68.9 | 2–6 | 54–88 |
| 102 | 30.3" | 97.5 | FM | 88–108 |
| 103 | 15.3" | 193.9 | 7–13 | 174–216 |
| 104 | 5.73" | 515.8 | 14–29 | 470–566 |
| 105 | 4.74" | 623 | 30–49 | 566–686 |
| 106 | 3.79" | 779 | 50–82 | 696–884 |

It is noted that the length of the sides of each loop are approximate and may be varied substantially without significantly affecting performance of the antenna. It will be apparent that in most of the instances shown in Table A, the channels intended to be covered by the various loops lie approximately within a 10 to 15 percent band width for each loop. It will be apparent to those skilled in the art that more or fewer antenna loops may be used for stronger or weaker signal reception, as may be desired. Similarly, the length of the sides and corresponding center frequencies may be adjusted as desired.

Figure 2:
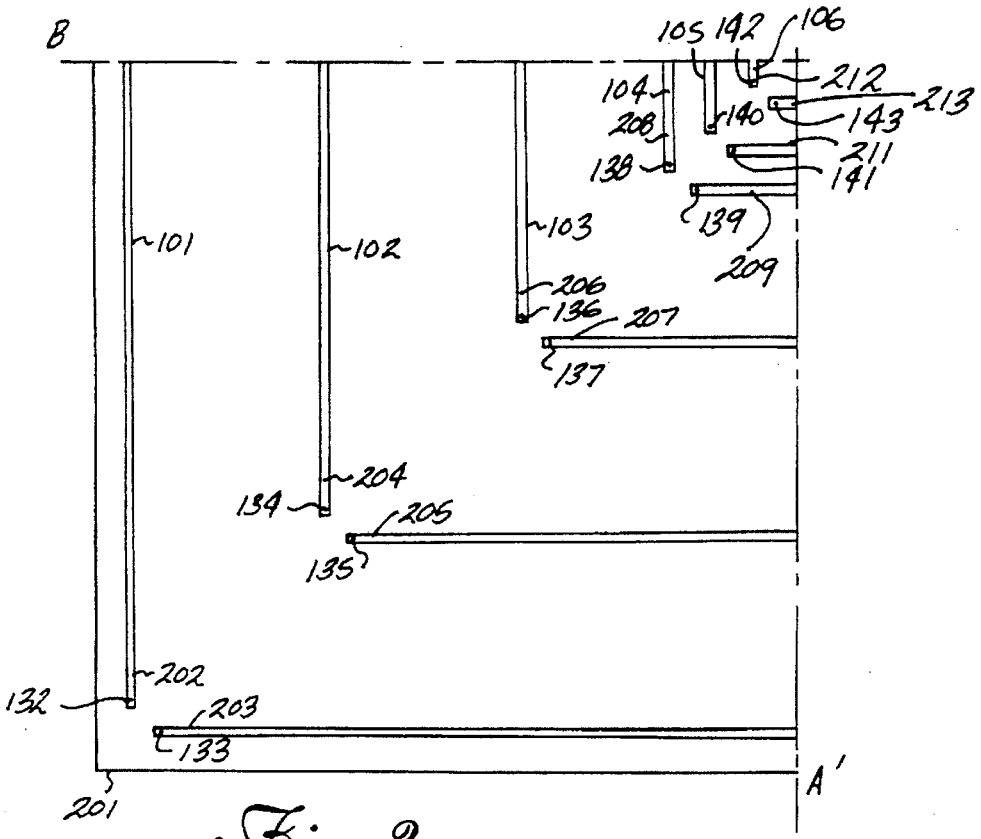
FIG. 2 is a plan view of a first quarter of the flat plate antenna of FIG. 1 showing conductor strips.

FIG. 2 is a plan view of one-quarter of a dielectric substrate 201 on which are deposited a number of conductive strips, each corresponding to a part of the antenna loops 101 through 106 of FIG. 1. The part of the antenna shown in FIG. 2 corresponds to the lower left quadrant bounded by portions of lines A–A' and B–B' of FIG. 1. The antenna loops 101 through 106 are formed by a thin strip of copper or the like conductive material deposited on dielectric substrate 201 which may be constructed of commercially available Mylar or similar material. The substrate is preferably sufficiently flexible to be readily adapted to be installed adjacent a contoured roof area. The conductive strips may be deposited on the substrate by means of standard deposition process such as used in printed circuit fabrication or may be discrete strips fastened to the substrate. The width of the conductive strips may, for example, be on the order of 0.1 inches. The thickness of the strips does not appear to have any substantial effect on the efficiency of the antenna due to the well-known skin effect. In copper conductors, the depth of current penetration for signals in the MHz frequency range is theoretically less than 0.1 millimeter. Commonly deposited conductive strips are substantially thicker than that.

Figure 4:
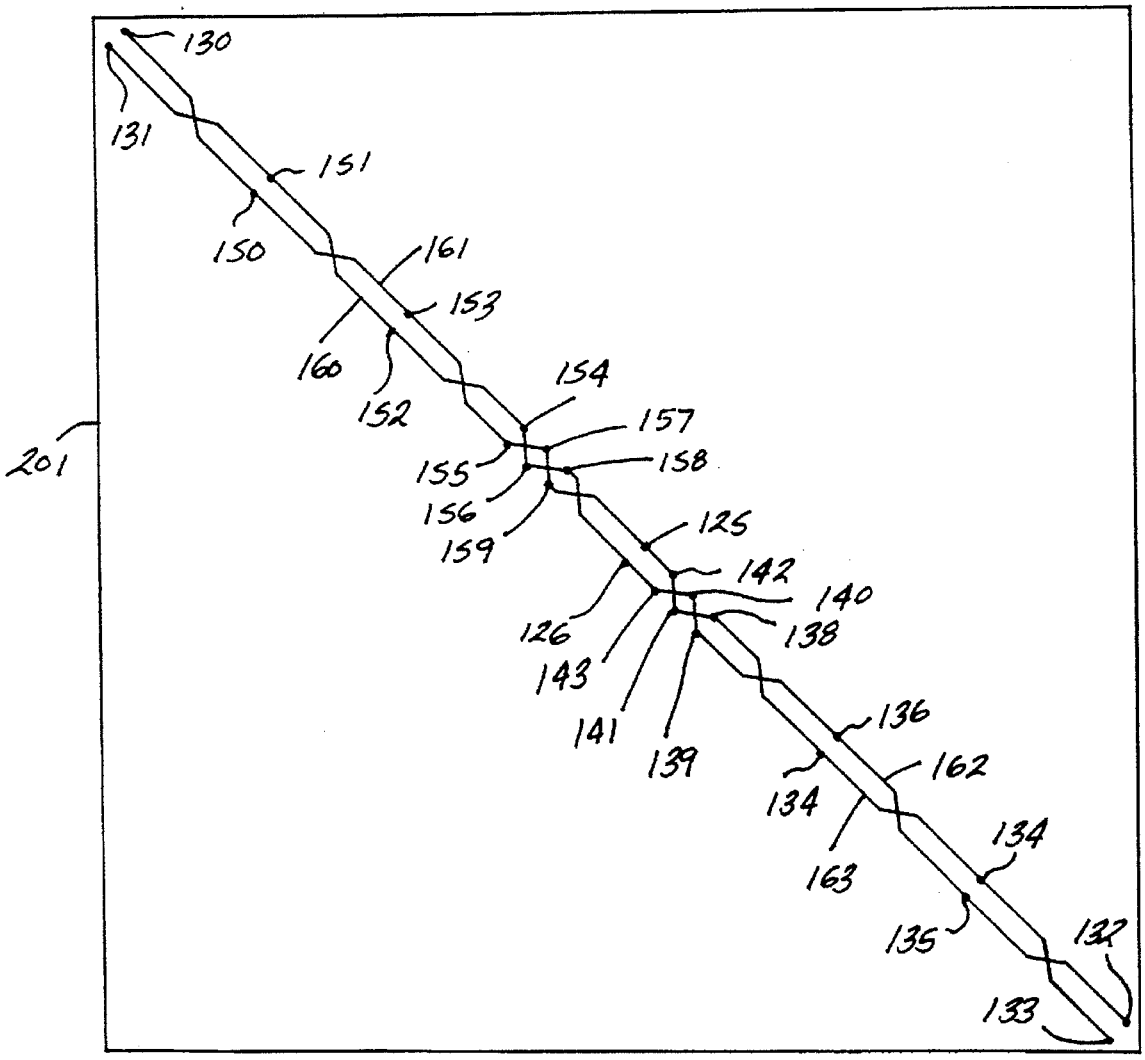
FIG. 4 is a bottom view of the first quarter of the flat plate antenna depicted in FIG. 2 showing a wire implementation of interconnections among antenna strips.

The conductive strips 202 through 213 depicted in FIG. 2 are interconnected by conductors 162, 163, shown in FIG. 1, which may be disposed on the underside of the substrate 201, such as shown in FIG. 4. A connection between the strips 202 through 213 and the conductors of FIG. 4 may be made by through-hole connections indicated by reference numerals 132 through 143, also shown in FIG. 1. Alternatively, the interconnecting conductors 160 through 163, shown in FIG. 2, extending between the concentric loops and to the antenna feed terminals 125, 126, may be formed by conductive strips on the top surface of substrate 201 and separated at crossover points in the fashion shown in FIG. 5. The relative position of the strips 202 through 213 on the substrate 201 is defined by the dimensions for each of the loops 102 through 106, as shown in Table A, and may be adjusted to accommodate loops of desired dimensions. Referring again to FIG. 1, the upper right-hand quadrant bounded by the lines A–A' and B–B' is a mirror image of the lower left-hand quadrant shown in FIG. 2 and the antenna structure in the upper right-hand quadrant is constructed in a similar fashion as the lower left-hand quadrant, as shown in FIG. 2.

Figure 3:
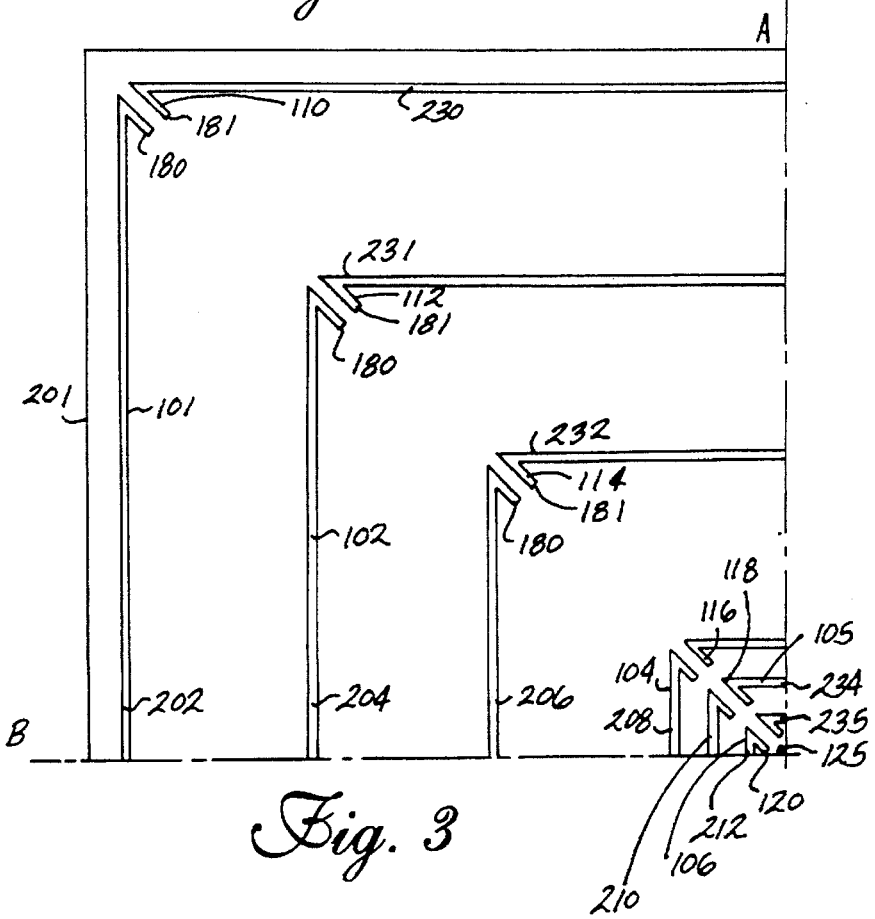
FIG. 3 is a plan view of a second quarter of the flat plate antenna of FIG. 1 showing conductor strips.

FIG. 3 shows a portion of the substrate 201 corresponding to the upper left-hand quadrant defined by the lines A–A' and B–B' of FIG. I and shows the capacitors 110, 112, 114, 116, 118 and 120 of FIG. 1 in a portion of each of the antenna loops 101 through 106. Each of the capacitors 110 through 121 of FIG. 1 is formed in the manner depicted in FIG. 2 which shows the capacitors 110, 112, 114, 116, 118 and 120 as formed by two parallel conductive strips 180, 181. The parallel conductive strips 180, 181 are each electrically connected to one of the conductive strips (e.g., 202, 204, etc. and 230, 231, etc.) forming a side of one of the square loops 101 through 106. The length of the parallel strips 140 may be adjusted to adjust the electrical length of each loop. The effective length of a loop placed under a dielectric roof or the like has been found to be influenced substantially by the thickness of the dielectric roof as well as the dielectric coefficient of the material from which the roof is constructed. To allow for adjustment of the antenna in various vehicle installations, the length of the capacitor strips 140, 142 of each of the capacitors may be trimmed such that the electrical length of each of the individual loops corresponds to the desired length for proper reception in a selected frequency band.

The lower right-hand quadrant of the antenna structure of FIG. 1 defined by the lines A–A' and B–B' is a mirror image of the upper left-hand quadrant shown in FIG. 3 and the antenna structure in the lower right-hand quadrant is constructed in the same manner as in the upper left-hand quadrant, as shown in FIG. 3. FIG. 4 is a plan view of the bottom surface of the substrate 201 showing the through-hole plated connections forming the connection points 130 through 143 and 150 through 159 shown in FIG. 1. The conductors 160, 161, 162 and 163 may be electrical wires or plated on the substrate 201 in a standard fashion. The conductor pairs 160, 161 and 162, 163 are shown in FIGS. 1 and 4 as crossing over each other. The crossovers aid in reducing extraneous signals resulting from extraneous cross-coupling of signals between the conductors and in balancing currents in opposite half sections of the antenna structure, as noted earlier herein with respect to FIG. 1.

Figure 5:
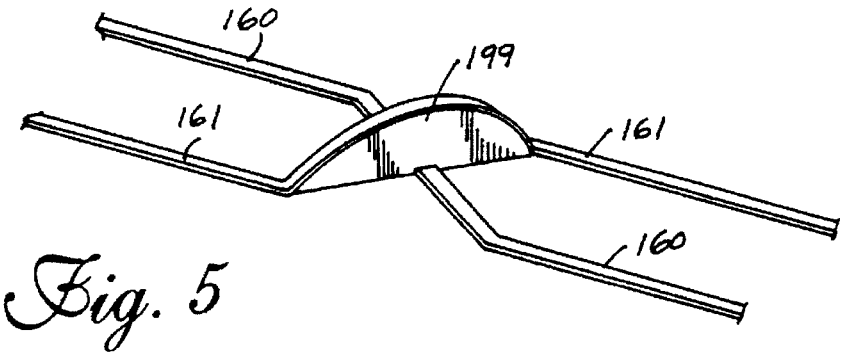
FIG. 5 is a perspective view of preferred embodiment of an interconnecting strip crossover.

In a preferred embodiment of the invention, the conductors 160, 161, 162, and 163 shown in FIG. 1 are preferably conductive strips deposited on the same side of the substrate 201 as the conductive strips forming the rectangular loops 101 through 106. As shown in FIG. 1 the conductors 160 and 161 and conductors 162 and 163 crossover each other between adjacent antenna loops. The conductors are insulated from each other by a dielectric material in a manner in FIG. 5, where a perspective view of one such crossover is shown. As shown in FIG. 5, the conductors 160, 161 are insulated and spaced apart from each other at the crossover by a semi-cylindrically shaped dielectric section 199. The dielectric section 199 is preferably dimensioned to provide sufficient separation between the two conductors in order to minimize cross-coupling of signals at the crossovers. The separation between conductors at the crossovers is preferably the same as the separation in the parallel sections of the conductors, e.g., the typical spacing of a 300 ohm transmission line.

Figure 6:
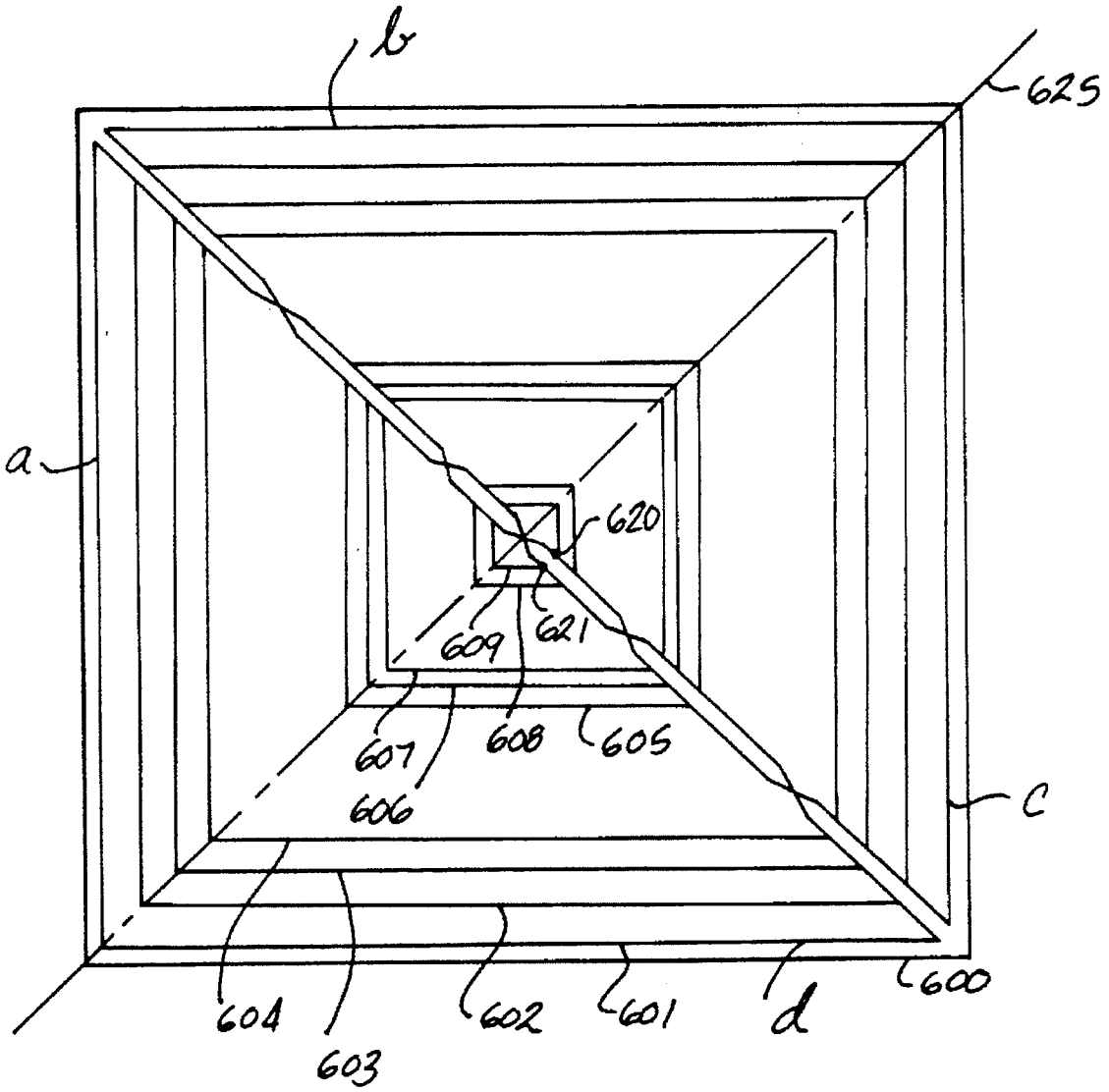
FIG. 6 is a schematic representation of an alternative embodiment of the invention.

FIG. 6 shows an alternate embodiment of a flat plate antenna module in which a plurality of antenna wires in the form of conducive strips are separately grouped around a grouping of television channels. It has been noted that better reception is obtained by the close spacing of antenna wires in the lower frequency television channels and that fewer antenna wires are necessary for the higher frequency channels. In the embodiment of FIG. 6 four separate antenna loops are provided to cover channels 2 through 6 in the 54 to 88 MHz frequency range. The four loops 601, 602, 603 and 604 are clustered and formed around the geometric center frequency of 68.9 MHz for channels 2 through 6. Loops 605, 606, and 607 are clustered and formed around the geometric center frequency of 193.9 MHz for the low band UHF range of channels 7 through 13. Loops 608 and 609 are designed around the geometric center frequency of approximately 623 MHz for the upper band UHF frequencies of channels 14 through 82.

TABLE B

| Loop # | Length of One Side | Center FREQ(MHz) | TV Channel | FREQ |
|---|---|---|---|---|
| 601 | 42.2" | 68.9 | 2–6 | 54–88 MHz |
| 602 | 38.29" | | | |
| 603 | 34.33" | | | |
| 604 | 31.39" | | | |
| 605 | 17.47" | 193.9 | 7–13 | 174–216 MHz |
| 606 | 15.30" | | | |
| 607 | 13.93" | | | |
| 608 | 6.25" | 646 | 14–82 | 470–890 |
| 609 | 3.79" | | | |

Each of the loops 601 through 609 consists of 4 separate sections of equal length namely, a, b, c, and d. The physical length of one side of each loop is indicated in table B. These lengths are empirically determined for improved reception in the pertinent frequency ranges. Table B indicates the grouping of the various loops and the TV channels covered by each grouping of loops. Each of the sections a, b, c and d has one end connected to one of two antenna terminals 620, 621 and has a free end. Each of the sections a, b, c and d has electrical length equivalent to one-quarter wave length in the frequency band for which the loop is designed. In the case of loops of the first group, namely 601 through 604, the a sections are electrically connected together and connected to the b sections of loops 605 through 607 and subsequently to the a sections of loop 608 and 609 and to antenna terminal 620. The b sections of loops 601 through 604 are interconnected and connected to the a sections of loops 605 through 607 and to the b sections of loops 608, 609 and the antenna terminal 621. In a similar fashion, the c sections of loops 601 through 604 are interconnected and connected to the d sections of 605 through 607 and to c sections of loops 608 and 609 and the antenna terminal 620. The d sections of loop 601 through 604 are connected to the c sections of loop 605 through 607 and to the d sections of loop 608, 609 and to the antenna terminals 621. The antenna terminals 620, 621 are connected via a standard antenna cable and may be connected to a TV set via a balun device commonly used with television antennas.

Each loop 601 through 609 comprises two half loops extending on opposite sides of a center line 625. Each half loop on one side of the center line consists of two quarter wave length sections a, b, and each half loop on the opposite side of the center line comprises two quarter wave length sections c, d. The two half loops together the two diametrically opposed sections e.g. a, c, and b, d are connected to the same antenna terminal.

In a preferred embodiment all connections from the various loop sections to the antenna terminals are made of the same side of the substraight 600 which the antenna sections are located. The antenna of FIG. 6 is preferably constructed of conductive strips the deposited on a low loss dielectric substraight which may be mounted inside the headliner of a truck cab or the like.

It will be understood that the above-described arrangement is merely illustrative of the application of the principles of the invention and that other arrangements may be advised by those skilled in the art without departing from the scope of the invention as defined by the appended claims.

What is claimed is:

1. A planar antenna module comprising:

a dielectric substrate;

a plurality of concentric loops formed of conductive material and disposed on the substrate;

first and second antenna terminals;

each loop comprising first and second opposing loop sections of like physical dimensions formed by two adjacent sides of one of the loops, the first and second opposing loop sections of each loop having adjacently disposed ends;

a first of the two adjacent sides of each loop having one end electrically connected to the first antenna terminal and a second of the two adjacent sides of each loop having one end connected to the second antenna terminal;

the first and second opposing loop sections together forming an antenna loop for signals within a predetermined frequency band;

the plurality of concentric antenna loops together forming an antenna structure for a plurality of frequency bands within a predetermined frequency spectrum.

2. The antenna module in accordance with claim 1 and further comprising a capacitor disposed between the adjacently disposed ends of the loop sections of each loop.

3. The antenna module in accordance with claim 2 wherein the loops of conductive material are formed from electrically conductive strips disposed on the dielectric substrate and each of the capacitors is formed by a pair of adjacently disposed conductive strips of conductive material disposed on the substrate and extending from the conductive strips forming the loops.

4. The antenna module in accordance with claim 3 wherein the dielectric substrate comprises a sheet of dielectric material and wherein the electrically conductive strips are deposited on the sheet by a deposition process.

5. A planar antenna module adapted for use in a an automotive vehicle and comprising:

a plurality of concentric loops formed of conductive material and disposed on a dielectric substrate and together forming an antenna for conducting signals in a plurality of frequency bands within a predefined frequency spectrum, each of the loops comprising first, second, third and fourth separate conductor sections of substantially equal length, each of the first, second, third, and fourth conductor sections having a first end and a second end;

a first and a second antenna terminal;

the first end of the first conductor section of an associated loop disposed adjacent the first end of the second conductor section of the associated loop and the second end of the first conductor section disposed adjacent the second end of the fourth conductor section of the associated loop;

the second end of the second conductor section of the associated loop disposed adjacent the second end of the third conductor section of the associated loop;

the first end of the third conductor section of the associated loop disposed adjacent the first end of the fourth conductor section of the associated loop; and the first end of the first conductor section and the first end of the third conductor section of the associated loop electrically connected to the first antenna terminal and the first end of the second conductor section and the first end of the fourth conductor section electrically connected to the second antenna terminal.

6. The antenna module in accordance with claim 5 wherein the second end of the first conductor section and the second end of the fourth conductor section of the associated loop are capacitively coupled, and wherein the second end of the second conductor section and the second end of the third conductor section of the associated loop are capacitively coupled.

7. The antenna module in accordance with claim 5 wherein the first end of the first conductor section of a one of the concentric loops is connected to the first end of the second conductor section of an adjacent concentric loop and to the first antenna terminal and wherein the first end of the second conductor section of the one concentric loop is connected to the first end of the first conductive section of the adjacent loop and to the second antenna terminal.

8. The antenna module in accordance with claim 5 wherein the first end of each conductive section is connected to the first end of a conductive section of another of the concentric loops and is further connected to one of the antenna terminals.

9. The antenna module in accordance with claim 5 wherein the separate conductor sections of each of the loops each have an electrical length equivalent to one quarter wavelength of a signal at a selected frequency in one of the frequency bands.

10. The antenna module in accordance with claim 9 wherein the plurality of frequency bands each have a center frequency and wherein the length of conductor sections of adjacent antenna loops equals one quarter wavelength at center frequencies of adjacent frequency bands.

11. The antenna module in accordance with claim 10 wherein each of the antenna loops has a bandwidth extending at least 20 percent of the center frequency of a predefined frequency band above and below the center frequency of the predefined frequency band.

12. An omnidirectional television antenna for use within a fiberglass structure comprising:

a dielectric substrate;

a plurality of strips of conductive material disposed on the substrate forming a plurality of concentric antenna loops together forming an antenna for receiving signals in a plurality of frequency bands together defining the television frequency spectrum;

the plurality of concentric loops comprising an innermost loop and an outermost loop and a plurality of intermediate loops;

each of the frequency bands having a center frequency;

each of the antenna loops comprising first, second, third and fourth separate conductor sections of equal length, the separate conductor sections of each antenna loop together forming a rectangularly shaped loop, each conductor section of each of the loops having an electrical length equivalent to one quarter wavelength of the center frequency of one of the frequency bands;

a first and a second antenna terminal;

each conductor section of each loop having a first end and a second end;

the first end of each conductive section of the outermost loop and of the intermediate loops electrically connected to the first end of a conductive section of the innermost loop, the first end of a conductor section of the innermost loop connected to one of the first and second antenna terminals;

the second end of the first section and the second end of the second section disposed adjacent each other and the first and second sections being capacitively coupled at respective second ends;

the second end of the third section and the second end of the fourth section disposed adjacent each other and the third and fourth sections being capacitively coupled at respective second ends;

each of the antenna loops having a bandwidth extending at least 10 percent of the center frequency of a predefined band in the television spectrum above and below the center frequency of the predefined frequency band.

13. A planar antenna module comprising:

a dielectric substrate;

a plurality of concentric loops formed of conductive material and disposed on the substrate, each loop having a perimeter length equivalent to one wavelength of signals at a center frequency of a frequency band in a multiband television frequency spectrum;

each loop comprising first and second opposing loop sections, each of the first and second opposing loop sections comprising a pair of electrically interconnected conductor sections of equal length, each of the conductor sections having one end electrically connected to an antenna lead wire, the first and second opposing loop sections having like physical dimensions and each of the first and second opposing loop sections forming a half wavelength antenna loop at a selected frequency in a predefined frequency spectrum.

14. The antenna module in accordance with claim 13 and further comprising a capacitor disposed between ends of each of the pairs of conductor sections and wherein the sections of each pair of conductor sections are interconnected via the capacitors.

15. The antenna module in accordance with claim 14 wherein the loops of conductive material are formed from electrically conductive strips and each of the capacitors is formed by a pair of adjacently disposed conductive strips of conductive material disposed on the substrate and extending from the conductive strips forming the loops.

16. The antenna in accordance with claim 15 wherein the dielectric substrate comprises a sheet of dielectric material and wherein the electrically conductive strips are deposited on the sheet by a deposition process.

17. The antenna in accordance with claim 15 wherein the loops of conductive material are interconnected and connected to antenna terminals via spaced apart interconnecting conductor strips on the substrate and wherein the interconnecting conductor strips include crossover sections and the interconnecting strip are spaced apart at the crossover sections by dielectric spacers providing separation between conductors at the crossover sections equal to a separation between spaced apart interconnecting conductors in other sections of the interconnecting conductors.

18. An omni-directional flat plate television antenna for use in an automotive vehicle and adapted for receiving television signals, the antenna comprising:

a first cluster comprising a first plurality of adjacently disposed concentric loops for receiving signals in a first television frequency range and having physical dimensions falling within a first range of dimensions;

a second cluster comprising a second plurality, smaller than the first plurality, of adjacently disposed concentric loops for receiving signals in second television frequency range, higher than the first television frequency range, the second cluster spaced apart from the first cluster and the concentric loops of the second cluster having physical dimensions falling within a second range of dimensions smaller than the first range of dimensions;

a third cluster comprising a third plurality of adjacently disposed concentric loops for receiving signals in a third frequency range higher than the second frequency range, the third cluster spaced apart from the second cluster and concentric loops having physical dimensions falling within a third range of dimensions smaller than the second range of dimensions;

each of the concentric loops comprising first, second, third and fourth separate conductor sections of substantially equal length, the first and second conductor sections of each loop extending on one side of a center line and extending toward the center line and the third and fourth conductor sections of each loop extending on another side of the center line and toward the center line;

a first and a second antenna terminal;

the first, second, third and fourth conductor sections of each loop arranged such that the first conductor section of a predefined loop has one end disposed adjacent one end of the second conductor section of the predefined loop and the third conductor section of the predefined loop has one end disposed adjacent one end of the fourth conductor section of the predefined loop;

the one end of the first, second, third and fourth conductor sections of each loop each connected to one of the antenna terminals.

19. The antenna in accordance with claim 18 wherein the one end of the first conductor sections of each loop of the first plurality of loops is electrically connected to the one end of the first conductor section of an adjacent loop of the first plurality of loops and to the one end of a second conductor section of a loop of the second plurality of loops and to the one end of the first conductor section of a loop of the third plurality of loops and to the first antenna terminal, and wherein the one end of each of the second conductor sections of each loop of the first plurality of loops is electrically connected to the one end of the second conductor section of an adjacent loop of the first plurality of loops and to the one end of a first conductor section of a loop of the second plurality of loops and to the one end of the second conductor section of a loop of the third plurality of loops and to the second antenna terminal.

20. The antenna in accordance with claim 19 wherein the one end of each of the third conductor sections of each loop of the first plurality of loops is electrically connected to the one end of the third conductor section of an adjacent loop of the first plurality of loops and to the one end of the fourth conductor section of a loop of the second plurality of loops and to the one end of the third conductor section of a loop of the third plurality of loops and to the first antenna terminal;

the one end of each of the fourth conductor sections of each loop of the first plurality of loops is electrically connected to the one end of the fourth conductor section of an adjacent loop of the first plurality of loops and to the one end of the third conductor section of a loop of the second plurality of loops and to the one end of the fourth conductor section of a loop of the third plurality of loops and to the second antenna terminal.

21. The antenna in accordance with claim 18 wherein the conductor sections of the first plurality of loops have an electrical length equivalent to one-quarter wavelength of signals in the UHF television frequency range and the conductor sections of the second and third plurality of loops have an electrical length equivalent to one-quarter wavelength of signals in the VHF television frequency range.

22. The antenna in accordance with claim 18 wherein the first plurality of loops comprises four separate loops and wherein the separate conductor sections of the separate loops of the first plurality of loops each has a length between approximately 31 inches and approximately 43 inches.

23. The antenna in accordance with claim 22 wherein the second plurality of loops comprises three separate loops and wherein each of the separate conductor sections of each of the separate loops of the second plurality has a length of between approximately 13 inches and approximately 18 inches.

24. The antenna in accordance with claim 23 wherein the third plurality of loops comprises two separate loops and wherein each of the separate conductor sections of each of the separate loops of the third plurality of loops has a length between approximately 3.5 inches and approximately 6.5 inches.

* * * * *